United States Patent [19]

Hutcheson

[11] Patent Number: 4,493,262

[45] Date of Patent: Jan. 15, 1985

[54] FUEL AIR EXPLOSIVE DEVICE

[75] Inventor: Don S. Hutcheson, College Park, Md.

[73] Assignee: The United States of America as represented by the Secretary of the Navy, Washington, D.C.

[21] Appl. No.: 438,683

[22] Filed: Nov. 3, 1982

[51] Int. Cl.[3] ..... F42B 27/00; F42C 15/02

[52] U.S. Cl. ..... 102/363; 102/368; 102/475; 102/487

[58] Field of Search ..... 102/363, 368, 482, 487, 102/425, 475

[56] References Cited

U.S. PATENT DOCUMENTS

| | | | |
|---|---|---|---|
| 1,994,081 | 3/1935 | Willners | 102/487 |
| 2,051,331 | 8/1936 | De Bobula | 102/487 |
| 3,570,401 | 3/1971 | Euker | 102/363 |
| 3,596,603 | 8/1971 | Gryting | 102/363 |
| 3,730,093 | 5/1973 | Cummings | 102/363 |
| 3,731,631 | 5/1973 | Berlin et al. | 102/487 |
| 3,940,443 | 2/1976 | Glass | 102/363 |
| 3,941,058 | 3/1976 | Gawlick et al. | 102/487 |
| 3,994,226 | 11/1976 | Rakowsky et al. | 102/363 |
| 4,066,019 | 1/1978 | Mehnert | 102/487 |
| 4,074,628 | 2/1978 | Manning et al. | 102/363 |
| 4,167,905 | 9/1979 | Kosonocky et al. | 102/487 |
| 4,220,091 | 9/1980 | Israels et al. | 102/487 |
| 4,285,277 | 8/1981 | Lerman | 102/487 |

*Primary Examiner*—Charles T. Jordan

*Attorney, Agent, or Firm*—Robert F. Beers; Kenneth E. Walden; John C. LaPrade

[57] ABSTRACT

The fuel air explosive (FAE) device of this invention is equipped with a gravity responsive unitary burster-detonator positioned in the liquid fuel, wherein the burster is heavier than the liquid fuel and the cloud detonator is lighter than the liquid fuel to provide for automatic means to orient the burster at the bottom of the fuel container and to simultaneously orient the cloud detonator at the top of the fuel container with hand operated release means on the exterior of the device to activate the burster and cloud detonator.

11 Claims, 3 Drawing Figures

FUEL AIR EXPLOSIVE DEVICE

BACKGROUND OF THE INVENTION

In fuel-air explosive (FAE) devices a burster functions to burst a container for a liquid fuel and that fuel is disseminated in air to form a cloud of fuel. At a subsequent time a cloud detonator detonates the cloud.

The FAE device of this invention is a particularly effective aerial weapon because the burster is positioned below the fuel level and the detonator is positioned at the upper level of the fuel, providing both blast and burning effects upon targets. Good efficiency per unit weight is obtained since only fuel is carried to the target and the ambient air comprises the oxidizer for the fuel. In such a weapon the fuel is explosively disseminated in a cloud which is detonated to provide destructive forces. Detonation of the mixture of fuel and air provides a blast effect and the combustion provides a flame which produces substantial damage.

The explosive charge is constituted of volatile hydrocarbons which:

do not require oxygen for spontaneous combustion (e.g. ethylene oxide, propylene oxide);

continue to burn without oxygen or air (e.g. propyl nitrate);

contain a high proportion of oxygen and cause a violent reaction on contact with combustible material (e.g. acetic peroxide);

explode on contact with moist air at ambient temperature (e.g. diborane);

react violently on contact with oxygen-rich materials and, in addition, ignite spontaneously on contact with certain substances.

In order to obtain maximum effectiveness of such weapons against most surface targets, it is desirable to disperse the fuel in a substantially pancake-shaped cloud within a few feet of the ground. It is found that since targets, such as personnel, vehicles and the like, are located at ground level, fuel disseminated at higher elevation is reacted and dissipated with little, if any, effect upon a target. In order to obtain pancake-shaped clouds of fuel an implosive technique has been devised for very rapid radial dissemination with minimized vertical displacement of the fuel. It is found with such weapons, however, when delivered from aircraft or the like so that the impacting weapon has a substantial vertical velocity, that the pancake-shaped cloud of disseminating fuel retains a vertical velocity component from the original falling weapon and is thereby driven into the ground at a range short of the maximum range obtainable.

Orientation of the cloud has also been a problem for FAE explosives. It is especially a problem when the charge must go off in contact with the ground. This problem might be attributed to the conventional burster configuration. The conventional burster is a central cylinder of high energy explosive which disperses the fuel radially when detonated. The fuel surrounds this explosive core in a cylindrical shape. The result is a burst pattern which resembles a donut; it has a hole in the center due to the explosive burster and is somewhat flat due to the lack of fuel dispersed in any other direction besides radial. This radial burst pattern acts detrimentally when the burster is not perpendicular to the ground orientation. One solution is to move away from the current configuration, to the more practical solution provided by this invention.

In an attempt to invent a FAE weapon which can be used as a demolition charge, the problems with ground effects have been addressed by moving towards more practical configurations for hand placed charges. One concept is to use the possible gains in blast effects of a hemispherical cloud by configuring the device like a hemisphere. This means that the burster is shaped like a hemisphere and the fuel surrounding the burster is hemispherically shaped too. Another concept might be to make the configuration spherical, using a spherical cannister for the fuel and a ball shaped burster. These configurations have some merit, but still must be placed to give the burster proper orientation with respect to the ground.

SUMMARY OF THE INVENTION

The invention is a FAE device particularly designed for use in buildings and bunkers where the vertical component of the fuel cloud and negation of ground effects are important. The explosive device of this invention may take the form of a small spherical grenade that contains a liquid fuel with a gravity responsive burster and cloud detonator that forces the burster to sink to the bottom of the fuel container and the cloud detonator to float to the top of the liquid level in the liquid container and so, orient the burster in the optimum position. In this arrangement the burster forces the fuel upward radially and outward from the ground.

It is therefore one primary object of the invention to provide a FAE device that is equipped with a gravity responsive burster that moves automatically to the optimum position prior to the first phase explosion after the device has come to rest in or near the target.

It is another object of the invention to provide a small grenade that has a release mechanism that allows the fusing system including burster and cloud detonator to orient by the force of gravity to optimum positions in the liquid fuel container of the grenade.

It is a still further object to provide a FAE grenade that forms a fuel cloud with improved efficiency of fuel usage over conventional FAE devices when in contact with the ground.

It is another object of the invention to provide a FAE device which may be thrown, catapulted, or launched in or near a target without fin or parachute stabilization to orient the components.

It is one additional object of the invention to provide a weapon with equal weight but more explosive power to infantryman engaged in urban warfare.

DESCRIPTION OF THE PREFERRED EMBODIMENT

Figure 1:
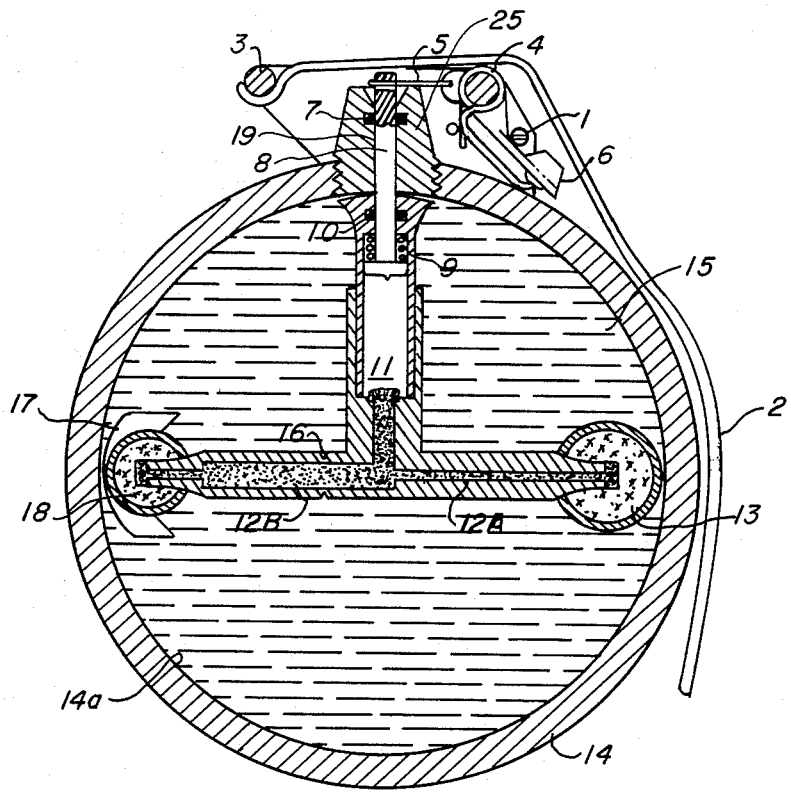
FIG. 1 is a cross-section of the fuel-air explosive device of this invention.

In FIG. 1 the outer shell 14 of the fuel air explosive device (grenade) is fitted with one opening 19 in the Bouchon assembly 25, into which a plunger striker 8 is fitted. Bouchon assemblies are well known in the art. The plunger-striker 8 is attached to exterior safety apparatus comprising a safety pin 1 and safety lever 2. The forward end of the lever 2 fits under and pivots about lug 3 that is part of the Bouchon assembly 25. After pin 1 is removed, the device is thrown and plug 6 rotates under the force of torsional spring 4 forcing lever 2 about lug 3 and away from the shell 14.

Pin 5 fits through and controls the upper end of the plunger-striker. When pin 5 is removed by rotation of plug 6 and associated pin spring 4 the plunger-striker 8 is forced downward by linear spring 9. The o-rings 7 and 10 serve to make the fuel container 14 fluid tight.

Figure 2:
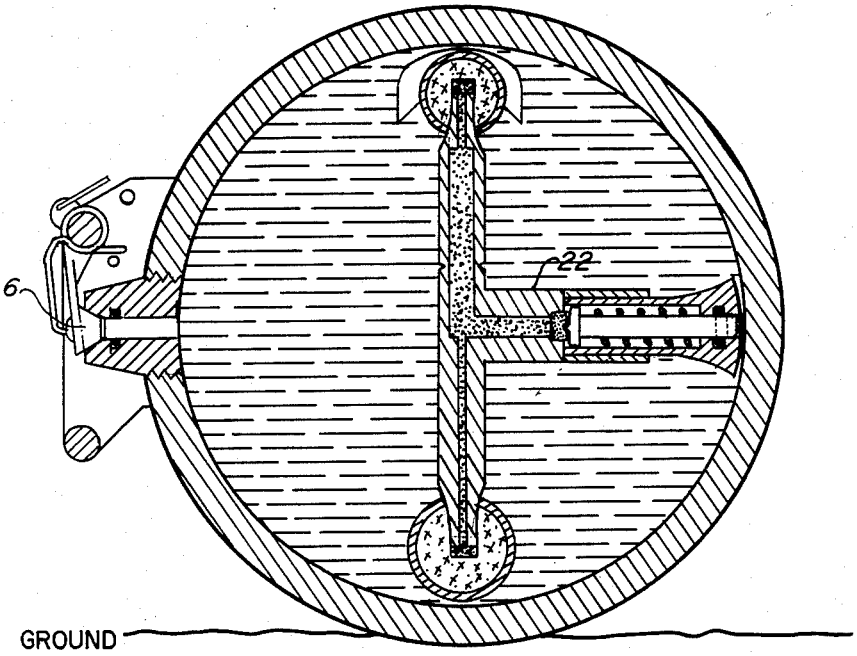
FIG. 2 is a cross-sectional view of FAE device in position after the fusing system has been released from the shell and device has rolled to its final position.

While plug 6, best shown in FIG. 2, reseals opening 19, the plunger-striker 8 moves down under the force of spring 9 to activate primer 11. At the same time, the plunger-striker 8 moves into the fuel container 14. The fuze system comprised of the burster 13, cloud detonator 18 and the delay elements 12A and 12B all respond to their respective specific gravities in the liquid fuel. The burster 13 and the delay element 12A sink to the bottom of the shell 14 because the specific gravity of the burster is greater than the specific gravity of the fuel 15. The detonator 18 and the delay element 12B float at the upper level of the fuel because the specific gravity of detonator is less than the specific gravity of the fuel 15. The burning rate and the length of delay element 12A controls the time of the initial explosion. This time will usually vary from 3 to 6 seconds after the grenade is thrown. The burning rate and length of delay element 12B controls the time of the second explosion in the cloud detonator. This time will vary from about 1 to 1.5 miliseconds after the initial explosion in the burster.

Figure 3:
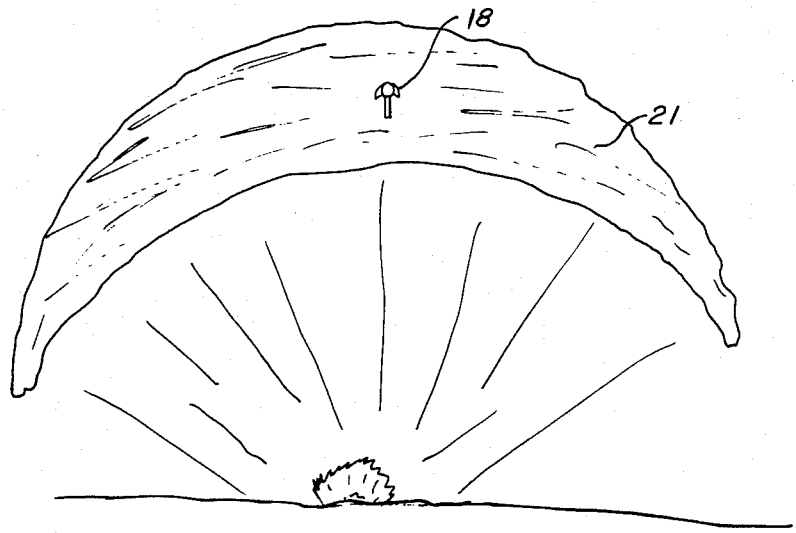
FIG. 3 is a isometric view of the fuel cloud ready to be detonated.

When the delay element 12A reaches the burster the burster 13 explodes, shattering the shell 14, the fuel 15 is dispersed to form a cloud 21. The burster of this invention functions to disperse the fuel radially upward and radially outward to form a cloud as shown in FIG. 3. The burster explosion also frees the cloud detonator 18, so that the detonator is forced upward and is located in the cloud 21.

Burster 13, is usually larger than the detonator 18 and is encased in a heavy metal case (i.e. stainless steel or other heavy alloy) so that the specific gravity of the burster 13, usually in the range of 1.0 to 1.5 will exceed the specific gravity of the fuel, that is usually less than one (1).

The cloud detonator is encased in a thin light weight material (i.e. polyethylene or thin aluminum foil with air pockets) and is fitted with directional drag fins 17 which may also have air pockets which keep the specific gravity under 1.0 preferably less than 0.75. The specific gravity of the detonator is usually less than 1.0.

The delay element 12B may be of a greater diameter than element 12A and may be of a different burning rate so as to burn more slowly, being timed to explode when the cloud is formed in a room or bunker or other space as best shown in FIG. 3.

The shape of the detonator may be cylindrical and the burster may also be cylindrical. This allows rotation of components about only the roll axis of the cylinder, rather than all three axis as in the sphere.

To those skilled in the art, many modifications and variations of the present invention are possible in light of the above teachings. It is therefore to be understood that the present invention can be practiced otherwise than as specifically describeq herein and still will be within the spirit and scope of the appended claims.

What is claimed as new and desired to be secured by Letters Patent of the United States is:

1. A device adapted to explode a fuel air mixture comprising:

a container having a casing enclosing a liquid fuel for defining an explosive when mixed with air, and a detonator and burster disposed within the container, said burster upon firing being adapted to burst the casing and force the fuel upward and outwardly to form a cloud of fuel air mixture;

wherein the burster and detonator are emersed in the liquid fuel with a plunger-striker means, and when the plunger-striker means is released the burster is positioned at the bottom of the liquid fuel and the cloud detonator is positioned at the top of the fuel level in the container prior to firing.

2. The explosive device of claim 1 wherein the detonator has a specific gravity less than the specific gravity of the fuel.

3. The explosive device of claim 1 wherein the burster has a specific gravity greater than the specific gravity of the fuel.

4. The fuel air explosive device of claim 1 wherein the device is spherical in shape.

5. A device adapted to explode a fuel air mixture comprising:

a container having a casing enclosing a liquid fuel for defining an explosive when mixed with air;

a detonator and burster disposed within the container; said burster and detonator being released by a plunger-striker means prior to firing and are positioned by the sinking of the burster and the floating to the detonator in the fuel immediately upon release by the plunger-striker means; and said burster upon firing being adapted to burst the casing and force the fuel upwardly and outwardly to form a cloud of fuel-air mixture, and to propel the detonator into the presence of the cloud.

6. A device adapted to explode a fuel-air mixture comprising a container with a casing enclosing a liquid fuel for defining an explosive when mixed with air; and a combined detonator and a burster comprising a unitary element with the burster positioned at one end and the detonator positioned at the other end and with delay elements connected to the burster and to the detonator disposed within the container, said burster upon firing being adapted to burst the casing and force the fuel upwardly and outwardly to form a cloud of fuel-air mixture;

said burster being adapted to propel the fuel and the detonator into the air and form a cloud of fuel and air containing the detonator; wherein the detonator and burster are released from a fixed position by a plunger-striker means and where associated means are provided to activate the burster and detonator and associated means to orient the burster at the bottom of the container and means to orient the cloud detonator at the upper level of the fuel in the container prior to firing and immediately upon release by the plunger-striker means.

7. The explosive device of claim 6 where the delay elements are activated by a percussion primer.

8. The explosive device of claim 7 wherein the percussion primer is activated by the plunger striker means.

9. The explosive device of claim 6 wherein the plunger striker means is released by removal of pin which is pulled by a torsional spring.

10. The explosive device of claim 6 wherein the delay elements allow the burster to fire first and the detonator to fire at a subsequent time.

11. The explosive device of claim 2 wherein the delay elements comprise one faster burning element in the burster and a slower burning element in the cloud detonator.

* * * * *